US005330864A

United States Patent [19]

Biavasco et al.

[11] Patent Number: 5,330,864

[45] Date of Patent: Jul. 19, 1994

[54] CYAN CHROMOGENIC LEUCO DYES FOR PHOTOTHERMOGRAPHIC MATERIALS

[75] Inventors: Raffaella Biavasco; Cristina Soncini, both of Savona, Italy

[73] Assignee: Minnesota Mining and Manufacturing Company, St. Paul, Minn.

[21] Appl. No.: 939,093

[22] Filed: Sep. 2, 1992

[30] Foreign Application Priority Data

Sep. 18, 1991 [IT] Italy ..... MI91A002467

[51] Int. Cl.[5] ..... G03C 1/498

[52] U.S. Cl. ..... 430/619; 430/617; 430/332; 430/343; 430/344; 430/345; 430/351

[58] Field of Search ..... 430/617, 619, 343, 344, 430/345, 332, 351

[56] References Cited

U.S. PATENT DOCUMENTS 4,670,374 6/1987 Bellus et al. ..... 430/505
4,889,932 12/1989 Miller ..... 544/348

FOREIGN PATENT DOCUMENTS 035262 9/1981 European Pat. Off. .
WO90/00978 2/1990 PCT Int'l Appl. .
1417588 12/1975 United Kingdom .

*Primary Examiner*—Thorl Chea
*Attorney, Agent, or Firm*—Gary L. Griswold; Walter N. Kirn; Mark A. Litman

[57] ABSTRACT

Phothermographic material capable of producing a high density cyan image upon image-wise exposure and thermal development at a relatively low temperature and for a short period of time. The photothermographic material of the invention comprise coated on a support base at least one light-sensitive emulsion layer containing: (a) a binder; (b) a silver source material; (c) a light sensitive silver halide in catalytic proximity to said silver source material, wherein said emulsion layer or an adjacent layer thereto comprises a chromogenic cyan leuco dye.

The photothermographic material of the invention may be used to obtain good cyan image of suitable density in single color or multicolor photothermographic articles. At the same time the chromogenic leuco dye is stable enough not to be oxidized by oxygen of the air or by simple heating and to limit the fog formation after development.

14 Claims, No Drawings

CYAN CHROMOGENIC LEUCO DYES FOR PHOTOTHERMOGRAPHIC MATERIALS

FIELD OF THE INVENTION

This invention relates to photothermographic materials and in particular to cyan chromogenic leuco dyes included in photothermographic materials.

BACKGROUND OF THE ART

Silver halide photothermographic imaging materials, especially "dry silver" compositions, processed with heat and without liquid development have been known in the art for many years. Such materials are a mixture of light insensitive reducible silver source material, a minor amount of light sensitive silver halide in catalytic proximity to the silver source material, and a reducing agent for the silver source.

The silver source material is a material which contains silver ions. The earliest and generally preferred silver source materials comprise silver salts of long chain carboxylic acids, usually of from 10 to 30 carbon atoms. The silver salt of behenic acid or mixtures of acids of like molecular weight have primarily been used.

The light sensitive silver halide is in catalytic proximity to the light insensitive silver salt such that the latent image formed by the irradiation of the silver halide serves as a catalyst nucleus for the oxidation-reduction reaction of the organic: silver salt with the reducing agent when heated above 80° C. Typically, the reducing agent is a colorless developer or else is a lightly colored leuco dye or dye forming developer that is oxidizable to a colored state. Such developers in photothermographic media are described in U.S. Pat. Nos. 3,457,075; 3,839,049; 3,985,565; and 4,260,667.

Multicolor photothermographic imaging articles typically comprise two or more monocolor-forming emulsion layers (often each emulsion layer comprises a set of bilayers containing the color-forming reactants) maintained distinct from each other by barrier layers. The barrier layer overlaying one photosensitive, photothermographic emulsion layer typically is insoluble in the solvent of the next photosensitive, photothermographic emulsion layer. Photothermographic articles having at least 2 or 3 distinct color-forming emulsion layers are disclosed in U.S. Pat. Nos. 4,021,240 and 4,460,681. Various methods to produce dye images and multicolor images with photographic color couplers and leuco dyes are well known in the art as represented by U.S. Pat. Nos. 4,022,617; 3,531,286; 3,180,731; 3,761,270; 4,460,681; 4,883,747 and Research Disclosure 29963.

A common problem that exists with these photothermographic systems is the instability of the image following processing. The photoactive silver halide still present in the developed image may continue to catalyze print-out of metallic silver even during room light handling causing a strong increase of fog after development. This is also increased by the presence of oxygen in the air which causes the oxidation of leuco dyes. For example, U.S. Pat. Nos. 4,670,374 and 4,889,932 describe photothermographic materials containing oxidable leuco phenazine, phenoxazine or phenothiazine dyes useful to give colour photothermographic images. Unfortunately they are subjected to aerial oxidation, which causes increasing fog after development.

Another problem is the lack of stability of the leuco dyes before exposure: in fact, in many cases, it is not possible to obtain any images because the leuco dye reacts in a non-image-wise way before exposure. The consequence of this non-image-wise reaction is the absence of sensitometric effects. This means that there is no difference in the print-out between the parts that should have produced an image and the parts that should not have produced any image. European Patent Application No. 35,262, and PCT Patent application No. WO 90-00,978 describe, respectively, non-silver copy materials and non-silver heat-sensitive materials both having leuco dyes with the same —$SO_2$— protecting group. These leuco dyes are useful in heat-sensitive materials. They are not useful in photothermographic materials because they do not react image-wise to give a dye image. In fact, when the material containing such leuco dyes is exposed and developed according to the usual process for photothermographic materials, it does not present any sensitometric effects.

Thus, there exists a need to have useful leuco dyes for photothermographic materials which are stable enough not to be aerially oxidised or by simple heating, and which limit fog formation after development to the simple print-out due to the presence of photosensitive silver halide. They also must react image-wise to provide a good dye image.

British Patent No. GB 1,417,586 describes the preparation of oxichromic compounds containing a reduced azomethine linkage. Such compounds produce upon chromogenic oxidation a chromophore useful in colour photographic systems, particularly in silver halide transfer materials. These oxichromic compounds may have a group which prevents oxidation of the N atom of the azomethine linkage and which hydrolizes off in alkaline solution and, in addition, they have a hydroquinone moiety in their structures. They are hence different from the compounds of the present invention and are used for a different purpose.

SUMMARY OF THE INVENTION

The present invention provides a photothermographic material capable of producing a high density cyan image upon imagewise exposure and thermal development at a relatively low temperature and for a short period of time. The photothermographic material of the invention comprises coated on a support base at least one light-sensitive emulsion layer containing: (a) a binder; (b) a silver source material; (c) a light sensitive silver halide in catalytic proximity to said silver source material, wherein said emulsion layer or an adjacent layer thereto comprises a chromogenic cyan leuco dye represented by the general formula I:

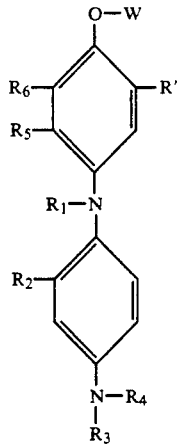

(I)

wherein $R_1$ is a —CONH—$R_8$ group, a —CO—$R_8$ group or a —CO—O—$R_8$ group, $R_8$ being an alkyl group (1 to 20 carbon atoms) or an aryl group (6 to 30 carbon atoms); $R_2$ is a hydrogen atom or a short alkyl group ($C_1$ to $C_4$); $R_3$ and $R_4$ may be the same or different including a hydrogen atom, a short alkyl group ($C_1$ to $C_4$), a —X—Y group, wherein X is a short alkylene group ($C_1$ to $C_4$) and Y is a cyano group, a halogen atom, —OH or —$NHSO_2$—Z group, wherein Z is an alkyl group (1 to 20 carbon atoms); $R_5$ is a hydrogen atom, a halogen atom, an alkyl group (1 to 20 carbon atoms), a NHCO—R group, wherein R is an alkyl group (1 to 20 carbon atoms) or an aryl group (6 to 20 carbon atoms); $R_6$ is a hydrogen atom, a halogen atom, an alkyl group (1 to 20 carbon atoms) or an alkoxy group (6 to 20 carbon atoms) or $R_5$ and $R_6$ can combine to form a benzene ring or a heterocyclic ring; R' is a hydrogen atom or is A-$R_7$ wherein A is a —NHCO— group, a —CONH— group or a —NHCONH— group, and $R_7$ is an alkyl group (1 to 20 carbon atoms) or an aryl group (6 to 30 carbon atoms), W is a hydrogen atom or a group as described for $R_1$.

In the present invention, the chromogenic cyan leuco dyes may be alternatively represented by general formula II:

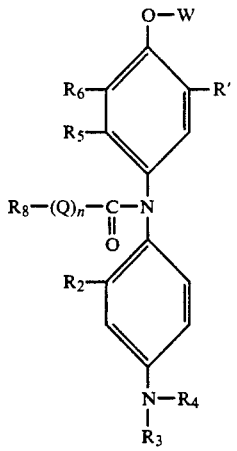

(II)

wherein $R_2$, $R_3$, $R_4$, $R_5$, $R_6$, $R_8$, R' and W have the same meanings as defined in formula (I); Q is —NH— or —O— and n is 0 or 1.

The photothermographic material of the invention may be used to obtain good cyan image of suitable density in single colour or multicolour photothermographic articles. At the same time the chromogenic leuco dye is stable enough not to be oxidised by oxygen of the air or by simple heating and to limit the fog formation after development.

DETAILED DESCRIPTION OF THE INVENTION

According to the present invention, the photothermographic material comprises coated on a support base at least one light-sensitive emulsion layer containing: (a) a binder; (b) a silver source material; (c) a light sensitive silver halide in catalytic proximity to said silver source material, wherein said emulsion layer or an adjacent layer thereto comprises a chromogenic cyan leuco dye represented by the general formula I:

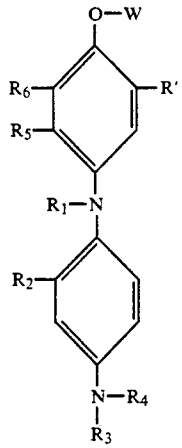

(I)

wherein $R_1$ is a —CONH—$R_8$ group, a —CO—$R_8$ group or a —CO—O—$R_8$ group, $R_8$ being an alkyl group, linear or branched (preferably of 1 to 20 carbon atoms, more preferably 1 to 8 carbon atoms, such as methyl, ethyl, butyl, etc.), or an aryl group; $R_2$ is a hydrogen atom or a short alkyl group (preferably 1 to 4 carbon atoms, such as methyl, ethyl, butyl); $R_3$ and $R_4$ may be either the same or different and each is hydrogen atom, a short alkyl group (preferably of 1 to 4 carbon atoms such as methyl, ethyl, etc.), a —X—Y group, wherein X is a short alkylene group (preferably of 1 to 4 carbon atoms, such as methylene, ethylene, etc.) and Y is a cyano group, a halogen atom, —OH or —$NHSO_2$—Z group, wherein Z is an alkyl group (preferably 1 to 20 carbon atoms, more preferably of 1 to 3 carbon atoms); $R_5$ is a hydrogen atom, a halogen atom (such as fluorine, bromine, chlorine, etc.), an alkyl group of up to 20 carbon atoms (such as methyl, ethyl, butyl, dodecyl, etc.), a NHCO—R group, wherein R is an alkyl group of up to 20 carbon atoms (such as methyl, ethyl, butyl, dodecyl, etc.), or an aryl group (6 to 20 carbon atoms, e.g. phenyl, naphthyl, thienyl); $R_6$ is a hydrogen atom, a halogen atom (such as fluorine, bromine, chlorine, etc.), an alkyl group of up to 20 carbon atoms (such as methyl, ethyl, butyl, dodecyl, etc.) or an alkoxy group of up to 20 carbon atoms (such as methoxy, ethoxy, etc.), or $R_5$ and $R_6$ can combine to form a benzene ring or a heterocyclic ring (such as a furan ring); R' is a hydrogen atom or is A-$R_7$ wherein A is a —NHCO— group, a —CONH— group or a —NHCONH— group, and $R_7$ is an alkyl group of up to 20 carbon atoms (such as methyl, ethyl, butyl, dodecyl, etc.) or an aryl group (6 to 30 carbon atoms, e.g. phenyl, naphthyl, thienyl), W is a hydrogen atom or a group as described for $R_1$.

The aryl group represented by R, $R_7$ or by $R_8$ of Formula (I) is, e.g., a phenyl group, a naphthyl group, or other aryl group of up to 30 carbon atoms, and preferably is a phenyl group. This group is allowed to have a single substituent or a plurality of substituents; for example, typical substituents introducible to the aryl group include halogen atoms (such as fluorine, chlorine, bromine, etc.), alkyl groups (such as methyl, ethyl, propyl, butyl, dodecyl, etc.), hydroxyl group, cyano group, nitro group, alkoxy groups (such as methoxy, ethoxy, etc.), alkylsulfonamido groups (such as methylsulfonamido, octylsulfonamido, etc.), arylsulfonamido groups (such as phenylsulfonamido, naphthylsulfonamido, etc.), alkylsulfamoyl groups (such as butylsulfamoyl), arylsulfamoyl (such as phenylsulfamoyl), alkyloxycarbonyl groups (such as methyloxycarbonyl), aryloxycarbonyl groups (such as phenyloxycarbonyl), aminosulfonamido groups, acylamino groups, carbamoyl groups, sulfonyl groups, sulfinyl groups, sulfoxy groups, sulfo groups, aryloxy groups, alkoxy groups, alkylcarbonyl groups, arylcarbonyl groups, aminocarbonyl groups, and the like. Two different members of these groups may be introduced to the aryl group. The preferred group represented by R or by $R_8$ is a phenyl group, the more preferred is a phenyl group having one or more substituents including halogen atoms and cyano groups.

As is well understood in this technical area, a large degree of substitution is not only tolerated but it is often advisable. As means of simplifying the discussion and recitation of these groups, the terms "group" and "moiety" are used to differentiate between chemical species that allow for substitution or which may be substituted. For example, the phrase "alkyl group" is intended to include not only pure hydrocarbon alkyl chains such as methyl, ethyl, octyl, cyclo-hexyl, isooctyl, tert-butyl and the like, but also such alkyl chains bearing such conventional substituents in the art such as hydroxyl, alkoxy, phenyl, halo (F, Cl, Br, I), cyano, nitro, amino, etc. The phrase "alkyl moiety" on the other hand is limited to the inclusion of only pure hydrocarbon alkyl chains such as methyl, ethyl, propyl, cyclo-hexyl, isooctyl, tert-butyl, and the like.

In the present invention, the preferred chromogenic cyan leuco dyes are the compounds having the following formula (II):

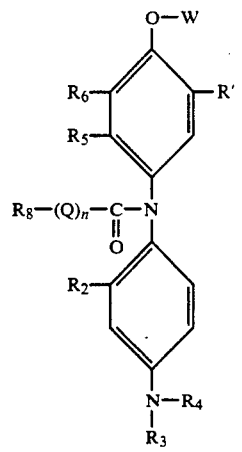

(II)

wherein $R_2$, $R_3$, $R_4$, $R_5$, $R_6$, $R_8$, R' and W have the same meanings as defined in formula (I) Q is —NH— or —O— and n is 0 or 1.

In the present invention, the preferred chromogenic cyan leuco dyes are the compounds having the following formula (III):

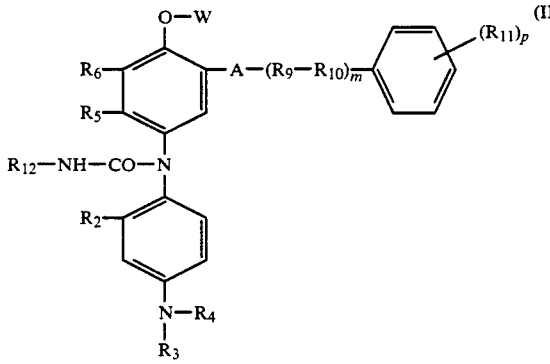

(III)

wherein A, $R_2$, $R_3$, $R_4$, $R_5$, $R_6$ and W are the same as before, $R_9$ is a branched-chain or a straight chain alkylene group of up to 10 carbon atoms (such as methylene, ethylene, butylene, etc.), $R_{10}$ is an oxygen atom or a sulfur atom, $R_{11}$ is a hydrogen atom or a substituent of the type described for the substituents of the aryl group indicated by R or by $R_8$ of Formula (I), $R_{12}$ is an alkyl group of up to 8 carbon atoms (such as methyl, ethyl, propyl, butyl, etc.) or an aryl group (such as phenyl, naphthyl, etc.), m is an integer of 0 to 1 and p is an integer of 0 to 4.

The more preferred chromogenic cyan leuco dyes in the present invention include those compounds having the following formula (IV):

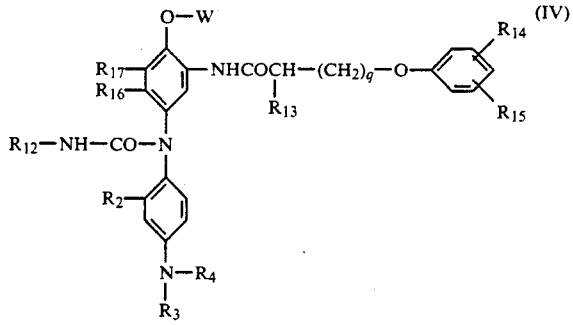

(IV)

wherein $R_2$, $R_3$, $R_4$ and $R_{12}$ are the same as before, $R_{13}$ is a hydrogen atom or an alkyl group of up to 20 carbon atoms (such as methyl, ethyl, propyl, 3-chloropropyl, butyl, pentyl, dodecyl, etc.), $R_{14}$ and $R_{15}$ may be either the same or different and each is a hydrogen atom, an alkyl group of up to 20 carbon atoms (such as methyl, ethyl, propyl, butyl, pentyl, dodecyl, etc.) or an alkoxy group of up to 20 carbon atoms (such as methoxy, ethoxy, etc.), provided that the sum of carbon atoms of $R_{13}$, $R_{14}$ and $R_{15}$ is from 8 to 20, $R_{16}$ and $R_{17}$ may be either the same or different and each is alkyl group of 1 to 2 carbon atoms (such as methyl or ethyl) or a halogen atom (such as fluorine, chlorine, bromine, etc.), or $R_{16}$ and $R_{17}$ can combine to form a benzene ring or a heterocyclic group; q is an integer of 0 to 2.

Specific examples of chromogenic cyan leuco dyes represented by the previous formulas (I) to (IV) are illustrated below, but the present invention is not limited thereby.

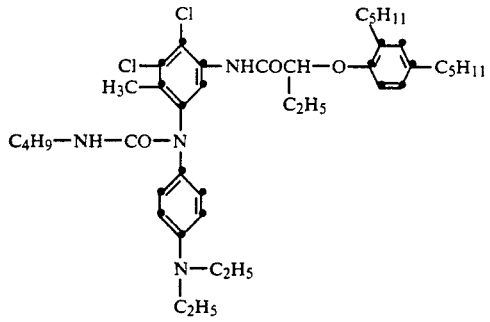

(1)

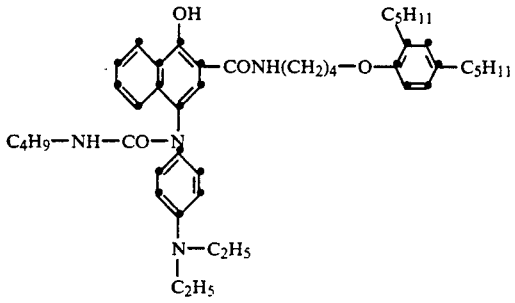

(2)

-continued

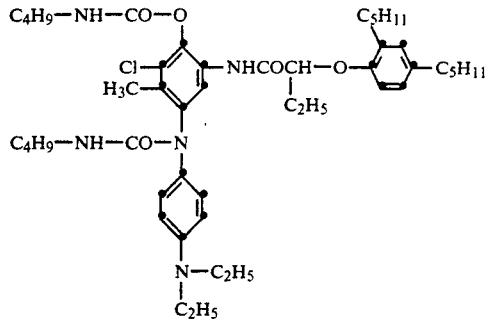

(3)

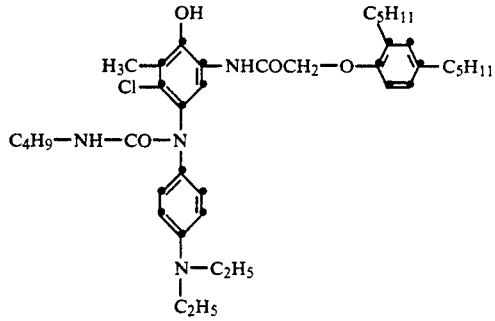

(4)

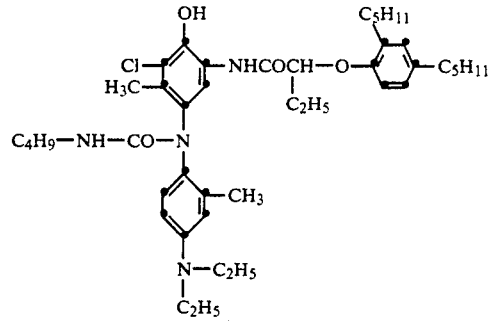

(5)

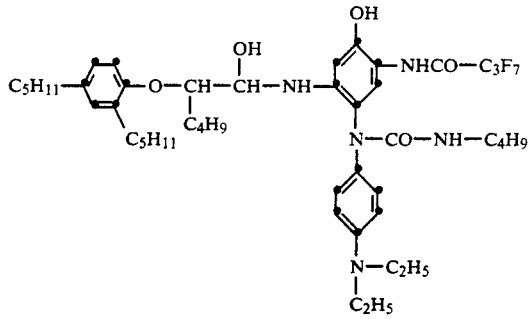

(6)

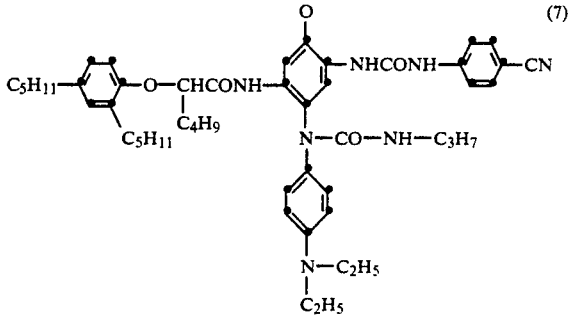

(7)

-continued
(8)
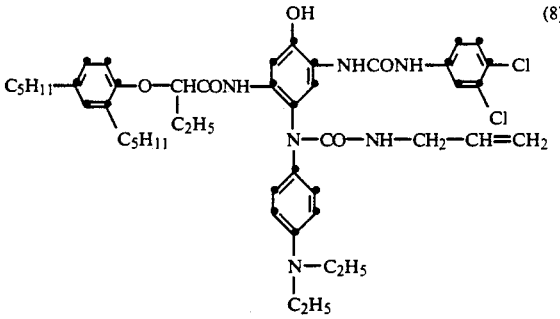
(9)
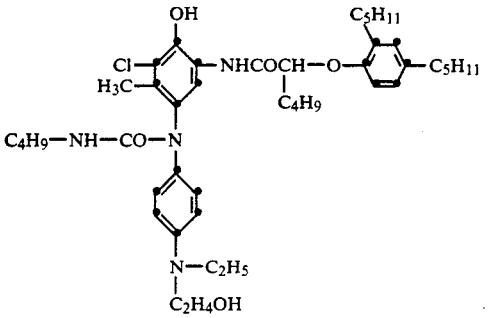
(10)
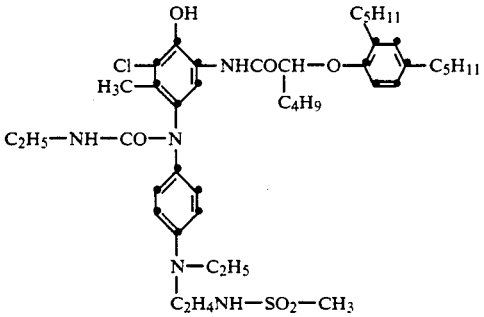
(11)
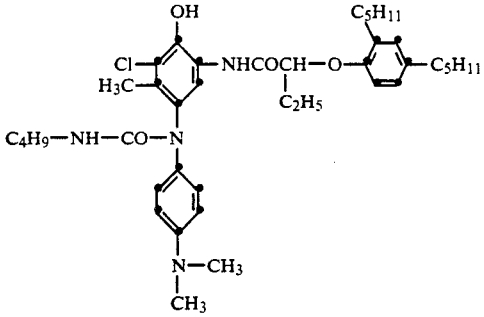
(12)
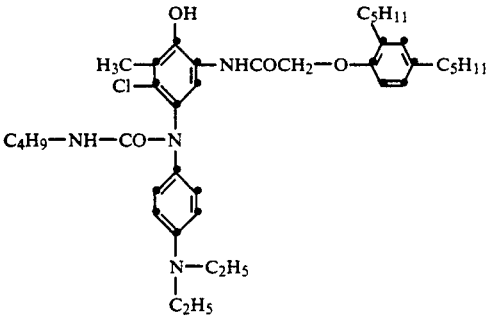
-continued
(13)
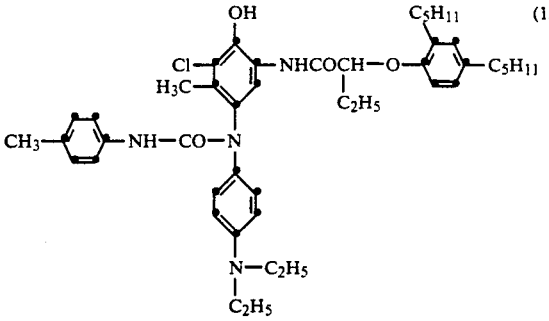
(14)
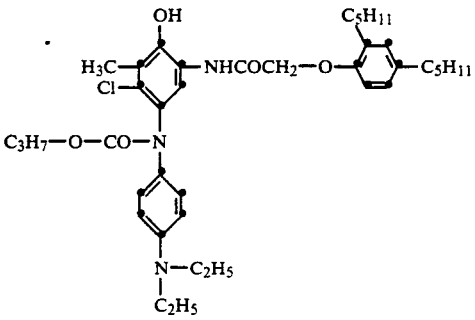
(15)
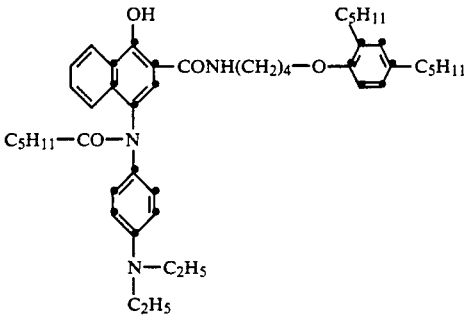
(16)
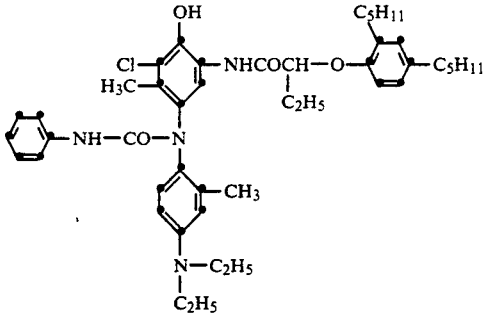
(17)
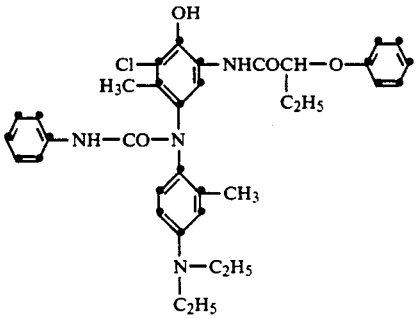

-continued (18)

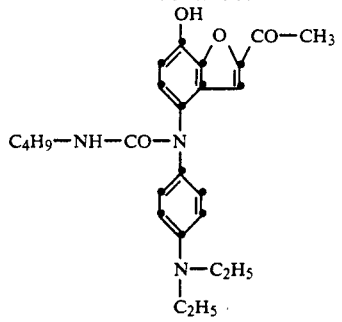

These exemplified compounds may be readily synthesized by reactions known in the art as shown below. Reactions were performed at room temperature unless otherwise stated.

Synthesis of Compound 1

4.76 g of 2-(4-(2,4-di-t-amylphenoxy(butyl)carbamoyl-1-naphthol and 2.63 g of 4-(N'-butylureido)-N,N-diethylaniline were dissolved in 160 ml of ethyl acetate. 400 ml of 5% aqueous sodium carbonate solution was added to the resultant solution. Then a solution of 7 g of potassium ferricyanide in 100 ml of water was added all at once to the above mixture. This was stirred vigorously for two minutes. The ethyl acetate layer was collected, washed once with water and allowed to stand one hour. The white compound precipitated was removed by filtration and washed with cold ethyl acetate; yield was 5 g.

| Analysis: $C_{46}H_{64}N_4O_4$ | |
|---|---|
| Required | Found |
| C 7496 | C 7443 |
| N 7.60 | N 7.70 |
| H 8.75 | H 8.77 |

Synthesis of Compound 3

3.2 g of 2-(2,2,3,3,4,4,5,5-octafluoropentamide)-5-(2-(2-4-di-t-amylphenoxy)propanamide)phenol and 1.3 g of 4-(N'-butylureido)-N,N-diethylaniline were dissolved in 80 ml of ethyl acetate. The mixture was stirred vigorously for two minutes. 200 ml of 5% aqueous sodium carbonate solution was added to the resultant solution. Then a solution of 3.5 g of potassium ferricyanide in 50 ml of water was added all at once to the above mixture. The ethyl acetate layer was collected, washed once with water and allowed to stand one hour. The extracts were evaporated and suspended in petroluem ether. The solid was removed by filtration and crystallised with ethyl acetate. Yield: 2.7 g.

| Analysis: $C_{40}H_{57}ClN_4O_4$ | |
|---|---|
| Required | Found |
| C 61.90 | C 61.76 |
| N 7.68 | N 7.77 |
| H 7.07 | H 7.11 |

Synthesis of Compound 5

4.94 g of 4,6-dichloro-5-methyl-2-(2-(2,4-di-t-amylphenoxy)propanamide)phenol and 2.63 g of 4-(N'-butylureido)-N,N-diethylaniline were dissolved in 160 ml of ethyl acetate. 400 ml of 5% aqueous sodium carbonate solution was added to the resulting solution. Then a solution of 7 g of potassium ferricyanide in 100 ml of water was added all at once to the above mixture. The mixture was stirred vigorously for five minutes. The ethyl acetate layer was collected, washed once with water and allowed to stand one hour. The solvent was dried and then evaporated. The residue was separated by column chromatography, using silica gel in cloroform. The extracts were evaporated and suspended in petroluem ether. The solid was removed by filtration and crystallised with ethyl acetate. Yield: 3 g.

| Analysis: $C_{42}H_{61}ClN_4O_4$ | |
|---|---|
| Required | Found |
| C 69.73 | C 69.82 |
| N 7.77 | N 7.84 |
| H 8.52 | H 8.62 |

The amounts of the above described compounds, which are added according to the present invention to at least one light-sensitive emulsion layer or to an adjacent layer, can be varied depending upon the particular compound used and upon the type of emulsion used. However, they are preferably added in an amount of $10^{-3}$ to 10 mol, and more preferably from $10^{-2}$ to 5 mol, per mol of silver halide in the emulsion layer.

The photothermographic dry silver emulsions used in the material of this invention may be constructed of one or more layers on a substrate. Single layer constructions may contain the silver source material, the silver halide, the developer and binder as well as optional additional materials such as toners, coating aids and other adjuvants. Two-layer constructions must contain the silver source and silver halide in one emulsion layer (usually the layer adjacent the substrate) and some of the other ingredients in the second layer or both layers.

Multicolor photothermographic dry silver constructions contain sets of these bilayers for each color. Color forming layers are maintained distinct from each other by the use of functional or non-functional barrier layers between the various photosensitive layers as described in U.S. Pat. No. 4,460,681.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant between 4.0 and 10.0 are also desirable. The silver source material constitutes from about 5 to 30 percent by weight of the imaging layer. The second layer in a two layer construction or in the bilayer of a multicolor construction would not affect the percentage of the silver source material desired in the photosensitive single imaging layer.

The organic silver salt which can be used in the present invention is a silver salt which is comparatively stable to light, but forms a silver image when heated to 800° C. or higher in the presence of an exposed photocatalyst (such as silver halide) and a reducing agent.

Suitable organic silver salts include silver salts of organic compounds having a carboxy group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myrristate, silver palmitate, silver maleate, silver fumarate, silver tartarate, silver furoate, silver linoleate, silver butyrate and silver camphorate, mixtures thereof, etc. Silver salts which are suitable with a halogen atom of a hydroxyl group can also be effectively used. Preferred examples of the silver salts of aromatic carboxylic acid and other carboxyl group-containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenyl benzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663, etc.

Silver salts of compounds containing mercapto or thione groups and derivatives thereof can be used. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethylglycolamido) benzothiazole, a silver salt of thioglycolic acid such as a silver salt of a S-alkyl thioglycolic acid (wherein the alkyl group has from 12 to 22 carbon atoms) as described in Japanese patent application No. 28221/73, a silver salt of a dithiocarboxylic acid such as a silver salt of dithioacetic acid, a silver salt of thioamide, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4,-thiazole, a silver salt of thione compound such as a silver salt of 3-(2-carboxyethyl)-4-methyl-4-thiazoline-2-thione as disclosed in U.S. Pat. No. 3,201,678.

Furthermore, a silver salt of a compound containing an imino group can be used. Preferred examples of these compounds include a silver salt of benzothiazole and a derivative thereof as described in Japanese patent publications Nos. 30270/69 and 18146/70, for example, a silver salt of benzothiazole such as silver salt of methylbenzotriazole, etc., a silver salt of a halogen substituted benzotriazole, such as a silver salt of 5-chlorobenzotriazole, etc., a silver salt of 1,2,4-triazole, of 1-H-tetrazole as described in U.S. Pat. No. 4,220,709, a silver salt of imidazole and an imidazole derivative, and the like.

It is also found convenient the use of silver half soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used.

The method used for making silver soap dispersions is well known in the art and is disclosed in Research Disclosure April 1983 (22812), ibid October 1983 (23419) and U.S. Pat. No. 3,985,565.

The light sensitive silver halide used in the present invention can be employed in a range of 0.005 mol to 0.5 mol and, preferably, from 0.01 mol to 0.15 mol per mol of organic silver salt.

The silver halide may be any photosensitive silver halide such as silver bromide, silver iodide, silver chloride, silver bromoiodide, silver chlorobromoiodide, silver chlorobromide, etc.

The silver halide used in the present invention may be employed without modification. However, it may be chemically sensitized with a chemical sensitizing agent such as a compound containing sulfur, selenium or tellurium etc., or a compound containing gold, platinum, palladium, rhutenium, rhodium or iridium, etc., a reducing agent such as a tin halide, etc., or a combination thereof. The details of these procedures are described in T. H. James "*The Theory of the Photographic Process*", Fourth Edition, Chapter 5, pages 149 to 169.

The silver halide may be added to the emulsion layer in any fashion which places it in catalytic proximity to the silver source.

The silver halide and the organic silver salt which are separately formed in a binder can be mixed prior to use to prepare a coating solution, but it is also effective to blend both of them in a ball mill for a long period of time. Further, it is effective to use a process which comprises adding a halogen-containing compound in the organic silver salt prepared to partially convert the silver of the organic silver salt to silver halide.

Methods of preparing these silver halide and organic silver salts and manners of blending them are described in Research Disclosures, No. 170-29, Japanese patent applications No. 32928/75 and 42529/76, U.S. Pat. No. 3,700,458, and Japanese patent applications Nos. 13224/74 and 17216/75.

Preformed silver halide emulsions in the material of this invention can be unwashed or washed to remove soluble salts. In the latter case the soluble salts can be removed by chill-setting and leaching or the emulsion can be coagulation washed, e.g., by the procedures described in Hewitson, et al., U.S. Pat. No. 2,618,556; Yutzy et al., U.S. Pat. No. 2,614,928; Yackel, U.S. Pat. No. 2,565,418; Hart et al., U.S. Pat. No. 3,241,969; and Waller et al., U.S. Pat. No. 2,489,341. The silver halide grains may have any crystalline habit including, but not limited to cubic, tetrahedral, orthorhombic, tabular, laminar, platelet, etc.

Photothermographic emulsions containing preformed silver halide in accordance with this invention can be sensitized with chemical sensitizers, such as with reducing agents; sulfur, selenium or tellurium compounds; gold, platinum or palladium compounds, or combinations of these. Suitable chemical sensitization procedures are described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

The light-sensitive silver halides can be spectrally sensitized with various known dyes include cyanine, styryl, hemicyanine, oxonol, hemioxonol and xanthene dyes. Useful cyanine dyes include those having a basic nucleus such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dye which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thazolinone nucleus, a malonitrile nucleus and a pyrazolone nucleus. In the above described cyanine and merocyanine dyes, those having imino groups or carboxyl groups are particularly effective. Practically, the sensitizing dyes to be used in the present invention is properly selected from known dyes as described in U.S. Pat. Nos. 3,761,279, 3,719,495 and 3,877,943, British Pat. Nos. 1,466,201, 1,469,117 and 1,422,057, Japanese Patent Application (OPI) Nos. 27924/76 and 156424/75, and so on, and can be located in the vicinity of the photocatalyst according to known methods used in the above-described examples. These spectral sensitizing dyes are used in amounts of about $10^{-4}$ mol to about 1 mol per 1 mol of photocatalyst.

The literature discloses additives, "toners", which improve the image. The materials may be present, for example, in amounts from 0.1 to 10 percent by weight of all silver bearing components. Toners are well known materials in the photothermographic art as shown in U.S. Pat. No. 3,080,254; 3,847,612 and 4,123,282.

Examples of toners include phthalimide and N-hydroxyphthalimide; cyclic imides such as succinimide, pyrazoline-5-ones, and a quinazolinone, 3-phenyl-2-pyrazoline-5-one, 1-phenylurazole, quinazoline and 2,4-thiazolidinedione; naphthalimides, e.g., N-hydroxy-1,8-naphthalimide; cobalt complexes, e.g., cobaltic hexamine trifluoroacetate; mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryl dicarboximides, e.g. (N-dimethylaminomethyl)-phthalimide, and N-(dimethylaminomethyl)naphthalene-2,3-dicarboximide; and a combination of blocked pyrazoles, isothiuronium derivatives and certain photobleach agents, e.g., a combination of N,N'-hexamethylene bis(1-carbamoyl-3,5-dimethylpyrazole), 1,8-(3,6-diazaoctane)bis-(isothiuronium trifluoroacetate and 2-(tribromomethylsulfonyl benzothiazole); and merocyanine dyes such as 3-ethyl-5 [(3-ethyl-2-benzothiazolinylidene)-1-methylethylidene]-2-thio-2,4-o-azolidinedione; phthalazinone, phthalazione derivatives or metal salts or these derivatives such as 4-(1-naphthyl)phthalazinone, 6-chlorophthalazinone, 5,7-dimethoxyphthalazinone, and 2,3-dihydro-1,4-phthalazinedione; a combination of phthalazinone plus sulfinic acid derivatives, e.g., phthalic acid, 4-methylphthalic acid, 4-nitrophthalic acid, and tetrachlorophthalic anhydride; quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate and potassium hexachlororhodate (III); inorganic peroxides and persulfates, e.g., ammonium peroxydisulfate and hydrogen peroxide; benzoxazine-2,4-diones such as 1,3-benzoxazine-2,4-dione,8-methyl-1,3-benzoxazine-2,4-dione, and 6-nitro-1,3-benzoxazine-2,4-dione; pyrimidines and asym-triazines, e.g., 2,4 -dihydroxypyrimidine, 2-hydroxy-4-aminopyrimidine, and azauracil, and tetrazapentalene derivatives, e.g., 3,6-dimercapto-1,4-diphenyl-1H,4H-2,3a,5,6a-tetrazapentalene, and 1,4-di-(o-chlorophenyl)3,6-dimercapto-1H,4H-2,3a.5.6a-tetrazapentalene.

A number of methods have been proposed for obtaining colour images with dry silver systems. Such methods include incorporated coupler materials, e.g., a combination of silver benzitriazole, well known magenta, yellow and cyan dye-forming couplers, aminophenol developing agents, a base release agent such as guanidinium trichloroacetate and silver bromide in poly(vinyl butyral); a combination of silver bromoiodide, sulphonamidophenol reducing agent, silver behenate, poly(vinyl butyral), an amine such as n-octadecylamine and 2-equivalent or 4-equivalent cyan, magenta or yellow dye- forming couplers; incorporating leuco dye bases which oxidizes to form a dye image, e.g., Malechite Green, Crystal Violet and pararosaniline; a combination of in situ silver halide, silver behenate, 3-methyl-1-phenylpyrazolone and N,N-dimethyl-p-phenylenediamine hydrochloride; incorporating phenolic leuco dye reducing agents such as 2-(3,5-di-tert-butyl-4-hydroxyphenyl)-4,5-diphenylimidazole, and bis-(3,5-ditert-butyl-4-hydroxyphenyl)phenyl)phenylmethane, incorporating azomethine dyes or azo dye reducing agents; silver dye bleach process, e.g., an element comprising silver behenate, behenic acid, poly(vinyl butyral), poly(vinyl-butyral)peptized silver bromoiodide emulsion, 2,6-dichloro-4-benzenesulfonamidophenol, 1,8-(3,6-diazaoctane)bis-isothiuronium-p-toluene sulfonate and an azo dye was exposed and heat processed to obtain a negative silver image with a uniform distribution of dye which was laminated to an acid activator sheet comprising polyacrylic acid, thiourea and p-toluene sulfonic acid and heated to obtain well defined positive dye images; and incorporating amines such as amino acetanilide (yellow dye-forming), 3,3'-dimethoxybenzidine (blue dye-forming) or sulfanilanilide (magenta dye forming) which react with the oxidized form of incorporated reducing agents such as 2,6-dichloro-4-benzene-sulfonamido-phenol to form dye images. Neutral dye images can be obtained by the addition of amines such as behenylamine and p-anisidine.

Leuco dye oxidation in such silver halide systems are disclosed in U.S. Pat. No. 4,021,240, 4,374,821, 4,460,681 and 4,883,747.

Silver halide emulsions containing the chromogenic cyan leuco dyes used in this invention can be protected further against the additional production of fog and can be stabilized against loss of sensitivity during keeping.

Suitable anti-foggants and stabilizers which can be used alone or in combination, include the thiazolium salts described in Staud, U.S. Pat. No. 2,131,038 and Allen U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et al., British Patent No. 623,448; nitron; nitroindazoles; the polyvalent metal salts described in Jones, U.S. Pat. No. 2,839,405; the thiuronium salts described by Herz, U.S. Pat. No. 3,220,839; and palladium, platinum and gold salts described in Trivelli, U.S. Pat. No. 2,566,263 and Damschroder, U.S. Pat. No. 2,597,915.

Stabilized emulsions used in the invention can contain plasticizers and lubricants such as polyalcohols, e.g., glycerin and diols of the type described in Milton, U.S. Pat. No. 2,960,404; fatty acids or esters such as those described in Robins, U.S. Pat. No. 2,588,765 and Duane, U.S. Pat. No. 3,121,060; and silicone resins such as those described in DuPont British Patent No. 955,061.

The photothermographic elements can include image dye stabilizers. Such image dye stabilizers are illustrated by U.K. Patent No. 1,326,889; Lestina et al. U.S. Pat. Nos. 3,432,300 and 3,698,909; Stern et al. U.S. Pat. No. 3,574,627; Brannock et al. U.S. Pat. No. 3,573,050; Arai et al. U.S. Pat. No. 3,764,337 and Smith et al. U.S. Pat. No. 4,042,394.

Photothermographic elements containing stabilized emulsion layers can be used in photographic elements which contain light absorbing materials and filter dyes such as those described in Sawdey, U.S. Pat. No. 3,253,921; Gaspar U.S. Pat. No. 2,274,782; Carroll et al., U.S. Pat. No. 2,527,583 and Van Campen, U.S. Pat. No. 2,956,879. If desired, the dyes can be mordanted, for example, as described in Milton and Jones, U.S. Pat. No. 3,282,699.

Photothermographic elements containing stabilized emulsion layers can contain matting agents such as starch, titanium dioxide, zinc oxide, silica, polymeric beads including beads of the type described in Jelley et al., U.S. Pat. No. 2,992,101 and Lynn, U.S. Pat. No. 2,701,245.

Emulsions stabilized in accordance with this invention can be used in photothermographic elements which contain antistatic or conducting layers, such as layers that comprise soluble salts, e.g., chlorides, nitrates, etc., evaporated metal layers, ionic polymers such as those described in Minsk, U.S. Pat. Nos. 2,861,056, and 3,206,312 or insoluble inorganic salts such as those described in Trevoy, U.S. Pat. No. 3,428,451.

The binder may be selected from any of the well-known natural or synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The preferred photothermographic silver containing polymer is polyvinyl butyral, butylethyl cellulose, methacrylate copolymers, maleic anhydride ester copolymers, polystyrene, and butadiene-styrene copolymers.

Optionally these polymers may be used in combination of two or more thereof. Such a polymer is used in an amount sufficient to carry the components dispersed therein, that is, within the effective range of the action as the binder. The effective range can be appropriately determined by one skilled in the art. As a guide in the case of carrying at least an organic silver salt, it can be said that a preferable ratio of the binder to the organic silver salt ranges from 15:1 to 1:2, and particularly from 8:1 to 1:1.

Photothermographic emulsions used in the invention can be coated on a wide variety of supports. Typical supports include polyester film, subbed polyester film, poly(ethylene terephthalate) film, cellulose nitrate film, cellulose ester film, poly(vinyl acetal) film, polycarbonate film and related or resinous materials, as well as glass, paper, metal and the like. Typically, a flexible support is employed, especially a paper support, which can be partially acetylated or coated with baryta and/or an alphaolefin polymer, particularly a polymer of an alpha-olefin containing 2 to 10 carbon atoms such as polyethylene, polypropylene, ethylenebutene copolymers and the like.

The substrate with backside resistive heating layer may also be used in color photothermographic imaging systems such as shown in U.S. Pat. No. 4,460,681 and 4,374,921.

Photothermographic emulsions used in this invention can be coated by various coating procedures including dip coating, air knife coating, curtain coating, or extrusion coating using hoppers of the type described in Benguin, U.S. Pat. No. 2,681,294. If desired, two or more layers may be coated simultaneously by the procedures described in Russell, U.S. Pat. No. 2,761,791 and Wynn British Patent No. 837,095.

The present invention will be illustrated in detail in reference to the following examples, but the embodiment of the present invention is not limited thereto.

EXAMPLE 1

A dispersion of silver behenate half soap was made at 10% solids in toluene and ethanol by homogenization. To 153.9 g of this silver half soap dispersion was added 253.3 g methyl ethyl ketone, 115.16 g isopropyl alcohol and 0.74 g of polyvinylbutyral. After 15 minutes of mixing, 5 ml of mereuric bromide (0.36 g/10 ml ethanol) were added. Then 10.0 ml of calcium bromide (0.236 g/10 ml ethanol) was added 30 minutes later. After three hours of mixing, 25.72 g of polyvinylpyrolidone was added, and 34.3 g of polyvinylbutyral was added one hour later.

To 20.54 g of the prepared silver premix described above was added 1.39 ml of the sensitizing dye D1 (0.045 g/58.26 g of ethanol and 19.42 g of toluene) shown below.

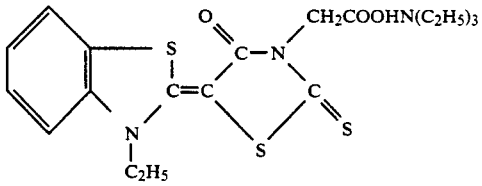

(D1)

After 20 minutes, the composition comprising the compound No. 1 of the present invention was added as shown below.

| Component | | Amount |
|---|---|---|
| Cyan Leuco Due (1) | g | 0.301 |
| Tribenzylamine | g | 0.170 |
| Phthalazinone | g | 0.110 |
| iso-Propanol | g | 1.93 |
| Toluene | g | 1.93 |

The resulting solution was coated at a wet thickness of 3 mils (0.076 mm) and dried at 85° C. for 5 minutes onto a polyester base. A topcoat solution was coated at a wet thickness of 3 mils (0.076 mm) and dried at 85° C. for 5 minutes over the silver halide layer. The topcoat solution consisted of 7% polyvinyl alcohol in an approximate 50:50 mixture of water and methanol; then 0.2% phthalazine and 0.2% of tetrachlorophthalic acid were added in methanol. When all particles were dissolved, 2.45 g of sodium acetate were added and the topcoat was stirred for an additional hour and kept at room temperature. Film 1 was obtained.

EXAMPLE 2

A sample prepared as described in Example 1 was obtained using the cyan leuco dye (2) instead of cyan leuco dye (1). Film 2 was obtained.

EXAMPLE 3

A sample prepared as described in Example 1 was obtained using the cyan leuco dye (3) instead of cyan leuco dye (1). Film 3 was obtained.

EXAMPLE 4

A sample prepared as described in Example 1 was obtained using the cyan leuco dye (4) instead of cyan leuco dye (1). Film 4 was obtained.

EXAMPLE 5

A sample prepared as described in Example 1 was obtained using the cyan leuco dye (5) instead of cyan leuco dye (1). Film 5 was obtained.

Example 6

A sample prepared as described in Example 1 was obtained using the cyan leuco dye (6) instead of cyan leuco dye (1). Film 6 was obtained.

EXAMPLE 7

A sample prepared as described in Example 1 was obtained using the cyan leuco dye (18) instead of cyan leuco dye (1). Film 7 was obtained.

EXAMPLE 8

A sample prepared as described in Example 1 was obtained using the cyan leuco dye (5) instead of cyan leuco dye (1) and using the red sensitizers D2 shown below instead of the yellow D1 sensitizers of above. Film 8 was obtained.

(D2)

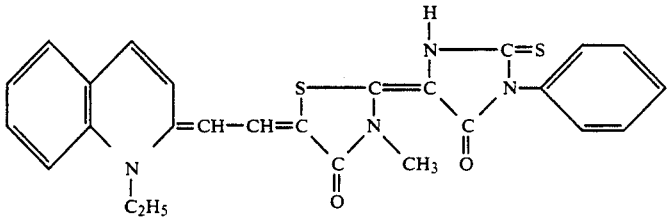

EXAMPLE 9 (comparison)

A sample prepared as described in Example 1 was obtained using the comparison cyan leuco dye A, prepared according European Patent Application No. EP 35,262, instead of cyan leuco dye (1). Film 9 was obtained. The comparison cyan leuco dye A has the following formula:

(A)

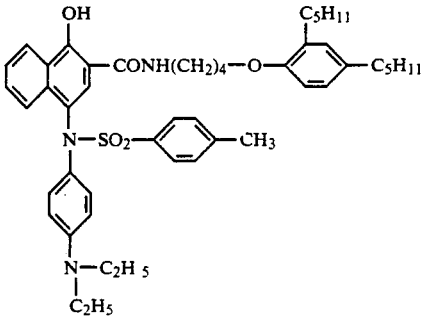

EXAMPLE 10 (comparison)

A sample prepared as described in Example 1 was obtained using the comparison cyan leuco dye B instead of cyan leuco dye (1). Film 10 was obtained. The comparison compound B has the following formula:

(B)

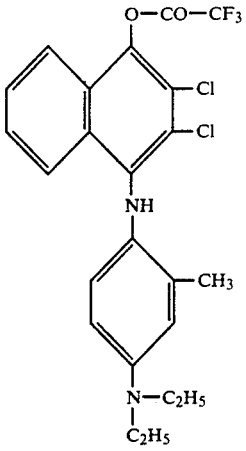

EXAMPLE 11

The samples prepared according to examples 1 to 10 were exposed for $10^{-3}$ seconds through a 47B Wratten filter and a 0 to 3 continuous wedge and developed by heating to approximately 138° C. for 6 seconds.

The density of the dye for each sample was measured using a blue filter of a computer densitometer. The initial sensitometric data are shown below in Table I:

TABLE I

| | Dmin | Dmax | Speed[1] | Contrast[2] |
|---|---|---|---|---|
| Film 1 | 0.18 | 2.26 | 1.25 | 3.35 |
| Film 2 | 0.15 | 1.78 | 1.86 | 1.70 |
| Film 3 | 0.15 | 2.30 | 1.37 | 2.29 |
| Film 4 | 0.15 | 2.27 | 1.43 | 2.25 |
| Film 5 | 0.15 | 1.58 | 1.37 | 2.79 |
| Film 6 | 0.16 | 0.84 | 3.40 | 0.57 |
| Film 7 | 0.14 | 0.80 | 2.82 | 0.80 |
| Film 8 | 0.17 | 2.31 | 1.72 | 3.04 |
| Film 9 | 0.34 | 0.47 | 3.40 | 0.00 |
| Film 10 | 1.89 | 2.00 | 0.40 | 0.00 |

[1]Log exposure corresponding to density of 0.6 above Dmin.
[2]Average contrast measured by the slope of the line joining density points 0.3 and 0.9 above Dmin.

Table I shows the good photographic data of films 1 to 8 related to materials containing cyan leuco dyes of the present invention. In fact, it shows low fog formation (Dmin) and high density (Dmax) and speed corresponding to the good image-wise exposing properties. Good contrast data are also shown.

On the other hand, Table I also shows that films 9 and 10, related to materials containing, respectively, comparison dyes A and B, are not useful in the present invention. In fact, they have a high Drain, meaning that a large amount of fog has been obtained. In addition, there is practically no difference in their values of Dmin and Dmax with the consequence of an absence of contrast data. That means that they do not have sensitometric results and hence they are not useful in light-sensitive photothermographic materials. The comparison dyes A and B differ from the compounds useful in the present invention in the fact that they do not have a protecting group on the nitrogen atom such as the —CONH—, —COO— or —CO— group present in the compounds of the present invention. In fact, comparison dye A has a —$SO_2$— protecting group not useful in the process for obtaining photothermographic images and not able to completely prevent aerial oxidation. Comparison dye B does not have any protecting groups on the nitrogen atom, with the consequence to be completely exposed to aerial oxidation (see the very high Dmin value).

EXAMPLE 12

Post-processing stability was tested by exposure of imaged samples to a 1076 Lux (day light) Xenon lamp for 20 minutes. After that treatment, sensitometric data have been measured and reported in Table II. No substantial changes in comparison with the initial sensitometric data have been observed. In particular, no substantial increasing of Drain after development has been noted.

On the contrary, comparison film 10 presented a very high Dmin, due to oxidation caused by light exposure, and, again, no substantial difference from the Dmax and the Dmin values.

TABLE II

| | Dmin | Dmax | Speed[1] | Contrast[2] |
|---|---|---|---|---|
| Film 1 | 0.32 | 2.33 | 1.79 | 3.11 |
| Film 2 | 0.43 | 1.54 | 2.68 | 1.36 |
| Film 3 | 0.29 | 2.22 | 1.95 | 3.02 |
| Film 4 | 0.29 | 2.32 | 1.74 | 2.82 |
| Film 5 | 0.25 | 1.40 | 2.04 | 2.14 |
| Film 6 | 0.34 | 0.87 | 3.40 | 0.70 |
| Film 7 | 0.32 | 0.83 | 2.82 | 0.80 |
| Film 8 | 0.40 | 2.32 | 1.74 | 2.82 |
| Film 9 | 1.39 | 1.47 | 0.40 | 0.00 |

[1]Log exposure corresponding to density of 0.6 above Dmin.
[2]Average contrast measured by the slope of the line joining density points 0.3 and 0.9 above Dmin.

EXAMPLE 13

The dispersion of silver behenate half soap composition of Example 1 not including the cyan leuco dye (1) was coated at a wet thickness of 3 mils (0.076 mm) and dried at 85° C. for 5 minutes onto a polyester base. To obtain a top coat solution, a mixture consisting in 24% by weight of polystyrene, 38% by weight of toluene and 38% by weight of methylethylketone was mixed for two hours. Then 6 g of the obtained mixture were added to a solution of 0.023 g of phthalazinone, 0.041 g of the cyan leuco dye (1), 0.021 g of sodium acetate dispersed in 0.50 ml of tetrahydrofuran and 0.55 ml of MeOH. The final topcoat composition was coated at a wet thickness of 3 mils (0.076 mm) and dried at 85° C. for 5 minutes over the silver halide layer. Film 11 was obtained.

EXAMPLE 14

The sample prepared according to example 13 was exposed for $10^{-3}$ seconds through a 47B Wratten filter and a 0 to 3 continuous wedge and developed by heating to approximately 138° C. for 6 seconds. The density of the dye was measured using a blue filter of a computer densitometer. The sensitometric data are shown below in Table III:

TABLE III

| | Dmin | Dmax | Speed[1] | Contrast[2] |
|---|---|---|---|---|
| Film 11 | 0.18 | 1.80 | 1.06 | 1.87 |

[1]Log exposure corresponding to density of 0.6 above Dmin.
[2]Average contrast measured by the slope of the line joining density points 0.3 and 0.9 above Dmin.

Table III shows the good sensitometric properties of film 11 of the present invention containing a cyan leuco dye in the topcoat composition.

What is claimed is:

1. A photothermographic material capable of producing a high density cyan image upon imagewise exposure and thermal development comprising coated on a support base at least one light-sensitive emulsion layer containing: (a) a binder; (b) a silver source material; (c) a light sensitive silver halide in catalytic proximity to said silver source material, wherein said emulsion layer or an adjacent layer thereto comprises a chromogenic cyan leuco dye represented by the general formula:

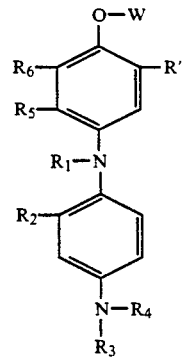

wherein $R_1$ is a —CONH—$R_8$ group, a —CO—$R_8$ group or a —CO—O—$R_8$ group, $R_8$ being an alkyl group or an aryl group; $R_2$ is a hydrogen atom or a short alkyl group; $R_3$ and $R_4$ may be the same or different including a hydrogen atom, a short alkyl group, a —X—Y group, wherein X is a short alkylene group and Y is a cyano group, a halogen atom, —OH or —NH-$SO_2$—Z group, wherein Z is an alkyl group; $R_5$ independently is a hydrogen atom, a halogen atom, an alkyl group, or a —NHCO—R group, wherein R is an alkyl group or an aryl group, and $R_6$ independently is a hydrogen atom, a halogen atom, an alkyl group, or an alkoxy group; or $R_5$ and $R_6$ can combine to form a benzene ring or a heterocyclic ring; R' is a hydrogen atom or is A—$R_7$, wherein A is a —NCHO— group, a —CONH— group, or a —NHCONH— group, and $R_7$ is an alkyl group or an aryl group, W is a hydrogen atom or a group as described for $R_1$.

2. A photothermographic material of claim 1 wherein the chromogenic cyan leuco dye is represented by the general formula:

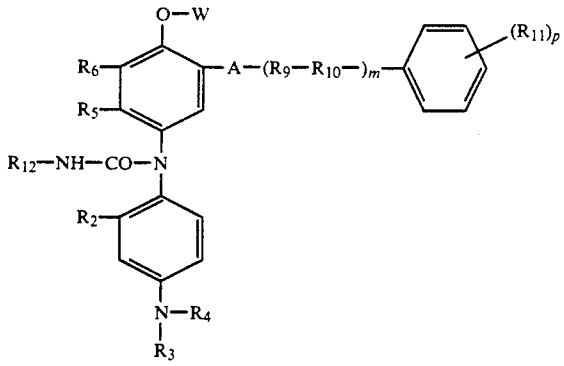

wherein $R_2$ is a hydrogen atom or a short alkyl group; $R_3$ and $R_4$ may be the same or different, each including a hydrogen atom, a short alkyl group, a —X—Y group, wherein X is a short alkylene group and Y is a cyano group, a halogen atom, —OH or —$NHSO_2$—Z group, wherein Z is an alkyl group; $R_5$ independently is a hydrogen atom, a halogen atom, an alkyl group, or a —NHCO—R group, wherein R is an alkyl group or an aryl group, and $R_6$ independently is a hydrogen atom, a halogen atom, an alkyl group, or an alkoxy group; or $R_5$ and $R_6$ can combine to form a benzene ring or a heterocyclic ring; A is a —NHCO— group, a —CONH— group or a —NHCONH— group; $R_9$ is a branched-chain or a straight chain alkylene group, $R_{10}$ is an oxygen atom or a sulfur atom, $R_{11}$ is a hydrogen atom, a halogen atom, a hydroxyl group, a nitro group, an alkyl group, an alkyloxycarbonyl group, an aryloxycarbonyl group, an alkoxy group, an aryloxy group, an alkylcarbonyl group, an arylcarbonyl group, an acyloxy group, an alkylsulfonyl group, an arylsulfonyl group, an acyl group, an acylamino group, a sulfonamido group or a sulfamoyl group, $R_{12}$ is an alkyl group or an aryl group; W is a hydrogen atom, a —CONH—$R_8$ group, a —CO—$R_8$ group or a —CO—O—$R_8$ group, $R_8$ being an alkyl group or an aryl group; m is an integer of 0 to 1 and p is an integer of 0 to 4.

3. A photothermographic material of claim 1 wherein the chromogenic cyan leuco dye is represented by the general formula;

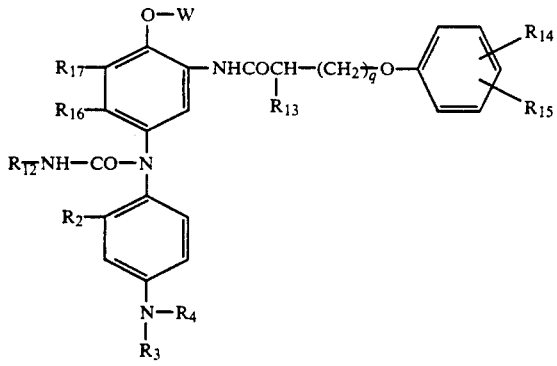

wherein $R_2$ is a hydrogen atom or a short alkyl group; $R_3$ and $R_4$ may be the same or different, each including a hydrogen atom, a short alkyl group, a —X—Y group, wherein X is a short alkylene group and y is a cyano group, a halogen atom, —OH or —$NHSO_2$—Z group, wherein Z is an alkyl group; $R_{12}$ is an alkyl group or an aryl group, $R_{13}$ is a hydrogen atom or an alkyl group, $R_{14}$ and $R_{15}$ may be either the same or different and each is a hydrogen atom, an alkyl group or an alkoxy group, provided that the sum of carbon atoms of $R_{13}$, $R_{14}$ and $R_{15}$ is from 8 to 20, $R_{16}$ and $R_{17}$ may be either the same or different and each is an alkyl group of 1 to 2 carbon atoms or a halogen atom, or $R_{16}$ and $R_{17}$ can combine to form a benzene ring or a heterocyclic ring; q is an integer of 0 to 2.

4. A photothermographic material of claim 1 wherein said silver source material is a silver salt of a long-chain fatty acid containing 10 to 30 carbon atoms.

5. A photothermographic material of claim 1 wherein said silver source material is silver behenate.

6. A photothermographic material of claim 1 wherein said binder is poly(vinylbutyral).

7. A photothermographic material of claim 1 wherein said chromogenic cyan leuco dye is present in an amount of $10^{-3}$ to 10 mol per mole of silver halide.

8. (Amended) A photothermographic material capable of producing a high density cyan image upon imagewise exposure and thermal development comprising coated on a support base at least one light-sensitive emulsion layer containing: (a) a binder; (b) a silver source material; (c) a light sensitive silver halide in catalytic proximity to said silver source material, wherein said emulsion layer or an adjacent layer thereto comprises a chromogenic cyan leuco dye represented by the general formula:

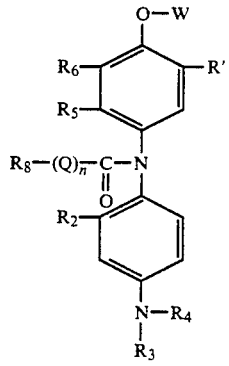

wherein $R_2$ is a hydrogen atom or a short alkyl group; $R_3$ and $R_4$ can be the same or different, each including a hydrogen atom, a short alkyl group, an —X—Y group, wherein X is a short alkylene group and Y is a cyano group, a halogen atom, —OH or —$NHSO_2$—Z group, where Z is an alkyl group; $R_5$ independently is a hydrogen atom, a halogen atom, an alkyl group, or a —NHCO—R group, wherein R is an alkyl group or an aryl group, and $R_6$ independently is a hydrogen atom, a halogen atom, an alkyl group, or an alkoxy group; or $R_5$ and $R_6$ can combine to form a benzene ring or a heterocyclic ring; R' is a hydrogen atom or is A-$R_7$, wherein A is a —NCHO— group, a —CONH— group, or a —NHCONH— group, and $R_7$ is an alkyl group or an aryl group; $R_8$ is an alkyl group or an aryl group; Q is —NH— or —O—; W is a hydrogen atom or a —CONH—$R_8$, —CO—$R_8$ or —CO—O—$R_8$ group and n is 0 or 1.

9. A photothermographic material of claim 8 wherein the chromogenic cyan leuco dye is represented by general formula:

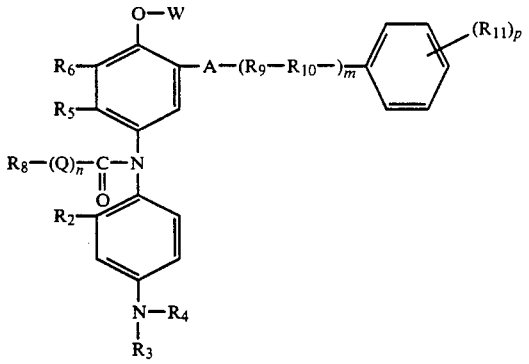

wherein $R_2$ is a hydrogen atom or a short alkyl group; $R_3$ and $R_4$ may be the same or different, each including a hydrogen atom, a short alkyl group, a —X—Y group, wherein X is a short alkylene group and Y is cyano group, a halogen atom, —OH or —$NHSO_2$—Z group, wherein Z is an alkyl group; $R_5$ independently is a hydrogen atom, a halogen atom, an alkyl group, or a —NHCO—R group, wherein R is an alkyl group or an aryl group, and $R_6$ independently is a hydrogen atom, a halogen atom, an alkyl group, or an alkoxy group; or $R_5$ and $R_6$ can combine to form a benzene ring or a heterocyclic ring; $R^8$ being an alkyl group or an aryl group; $R_9$ is a branched or straight chain alkylene group, $R_{10}$ is an oxygen or a sulfur atom, $R_{11}$ is a hydrogen atom, a halogen atom, a hydroxyl group, a nitro group, an alkyl, alkyloxycarbonyl, aryloxycarbonyl, alkoxy, aryloxy, alkylcarbonyl, arylcarbonyl, acyloxy, alkylsulfonyl, arylsulfonyl, acyl, acylamino, sulfonamido or sulfamoyl group; A is a —NHCO— group, a —CONH group or a —NHCONH— group; W is a hydrogen atom or a —CONH—$R_8$ group, a —CO—$R_8$ group or —CO—O—$R_8$ group; Q is —NH— or —O—; m is an integer from 0 to 1 and p is an integer from 0 to 4; n is 0 or 1.

10. A photothermographic material of claim 8, wherein the chromogenic cyan leuco dye is represented by general formula:

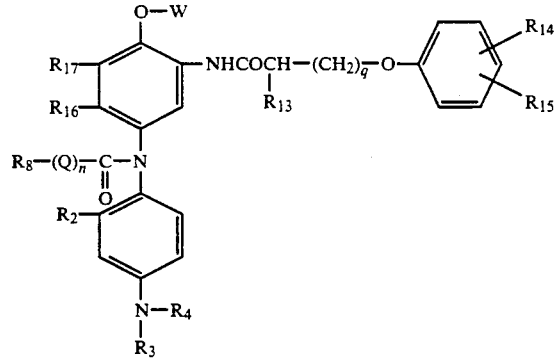

wherein $R_2$ is a hydrogen atom or a short alkyl group; $R_3$ and $R_4$ may be the same or different, each including a hydrogen atom, a short alkyl group, a —X—Y group, wherein X is a short alkylene group and Y is cyano group, a halogen atom, —OH or —$NHSO_2$—Z group, wherein Z is an alkyl group; $R_8$ being an alkyl group or an aryl group; $R_{13}$ is a hydrogen atom or an alkyl group, $R_{14}$ and $R_{15}$ may be the same or different and each is a hydrogen atom, an alkyl or an alkoxy group, with the proviso that the sum of the carbon atoms of $R_{13}$, $R_{14}$ and $R_{15}$ is from 8 to 20; $R_{16}$ and $R_{17}$, may be the same or different and each is a 1 to 2 carbon atom alkyl group or a halogen atom, or $R_{16}$, and $R_{17}$ can combine together to form a benzene ring or a heterocyclic ring; Q is —NH— or —O—; n is 0 or 1; q is an integer from 0 to 2.

11. A photothermographic material of claim 8, wherein said silver source material is a silver salt of a long chain fatty acid containing from 10 to 30 carbon atoms.

12. A photothermographic material of claim 8, wherein said silver source material is silver behenate.

13. A photothermographic material of claim 8, wherein said binder is poly-(vinylbutyral).

14. A photothermographic material of claim 8, wherein said chromogenic cyan leuco dye is present in a quantity from $10^{-3}$ to 10 moles per mole of silver halide.

* * * * *